US006883872B1

(12) United States Patent
Su

(10) Patent No.: US 6,883,872 B1
(45) Date of Patent: Apr. 26, 2005

(54) ADJUSTABLE ARMREST WITH AN AUXILIARY SECURITY UNIT

(76) Inventor: Wen-Fa Su, No. 42, Hsing Ya Rd., Chia Yi (TW)

( * ) Notice: Subject to any disclaimer, the term of this patent is extended or adjusted under 35 U.S.C. 154(b) by 0 days.

(21) Appl. No.: 10/747,409

(22) Filed: Dec. 30, 2003

(51) Int. Cl.[7] ..... A47C 7/54
(52) U.S. Cl. ..... 297/411.35; 297/411.2; 297/411.36
(58) Field of Search ..... 297/411.36, 411.35; 248/118.3, 118.1

(56) References Cited

U.S. PATENT DOCUMENTS 5,393,124 A * 2/1995 Neil ..... 297/411.35
5,599,067 A * 2/1997 Schuelke et al. ..... 297/411.35
5,752,683 A * 5/1998 Novis et al. ..... 248/118
5,853,223 A * 12/1998 Ritt et al. ..... 297/411.36
6,022,079 A * 2/2000 Bergsten et al. ..... 297/411.35
6,296,312 B1 * 10/2001 Congleton et al. ..... 297/411.35
6,419,323 B1 * 7/2002 Chu et al. ..... 297/411.35
6,502,904 B1 * 1/2003 Hansen ..... 297/411.35
6,619,747 B1 * 9/2003 Ko et al. ..... 297/423.12

* cited by examiner

*Primary Examiner*—Peter M. Cuomo
*Assistant Examiner*—Erika Garrett
(74) *Attorney, Agent, or Firm*—Rosenberg, Klein & Lee

(57) ABSTRACT

An armrest of a chair includes an armrest main body arranged on one side of a seat of a chair for allowing a sitter to rest one hand thereon, an adjustment mechanism connected to both the seat and the armrest main body for adjusting the armrest main body with, and an auxiliary security unit securely located opposite an outward side of the armrest main body for allowing the sitter to press the hand against when the sitter is standing up from the seat; thus, the sitter doesn't have to press his the hand against the armrest main body, which might lock ineffectively after adjustment, and will move to cause accidents if the sitter presses it hard when standing up.

1 Claim, 4 Drawing Sheets

ADJUSTABLE ARMREST WITH AN AUXILIARY SECURITY UNIT

BACKGROUND OF THE INVENTION

1. Field of the Invention

The present invention relates to an adjustable armrest of a chair, more particularly one, which is equipped with an auxiliary security unit for preventing a sitter from getting hurt accidentally in using the chair.

2. Brief Description of the Prior Art

It is a major concern of chair manufacturers to be able to provide more comfortable and convenient chairs to the consumers, e.g. ones that are equipped with adjustable armrests. While being seated on a chair with armrests, the sitter can rest his arms on the armrests comfortably, and when standing up from the chair, he can press his hands against the armrests, and prop his upper body up with the help of the hands in such a way as to stand up more easily.

Referring to FIGS. 3 and 4, a chair is equipped with armrests 31 on two sides of the seat 3 thereof, and adjustment mechanisms 32 such that the armrests 31 can be adjusted in the height for suiting the sitter's need. And, chairs of such kind (not shown) are also available that are equipped with armrests adjustable in both the height and the orientation relative to the seat.

However, adjustable armrests of a chair will be easily moved in case the user fails to lock the armrests effectively after adjusting the armrests. Consequently, the sitter can fall over, and get hurt accidentally in case the sitter presses his/her hands against the armrests, and uses the armrests to support a large proportion of his/her body weight while he/she is standing up from the seat.

SUMMARY OF THE INVENTION

It is a main object of the present invention to provide an auxiliary security unit to an adjustable armrest of a chair to overcome the above disadvantage.

The adjustable armrest of the present invention includes an armrest main body arranged on one side of a seat of a chair for allowing a sitter to rest one hand thereon, an adjustment mechanism connected to both the seat and the armrest main body for adjusting the armrest main body with, and an auxiliary security unit securely located opposite an outward side of the armrest main body for allowing the sitter to press the hand against when the sitter is standing up from the seat; thus, the sitter doesn't have to press his the hand against the armrest main body, which might lock ineffectively after adjustment.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
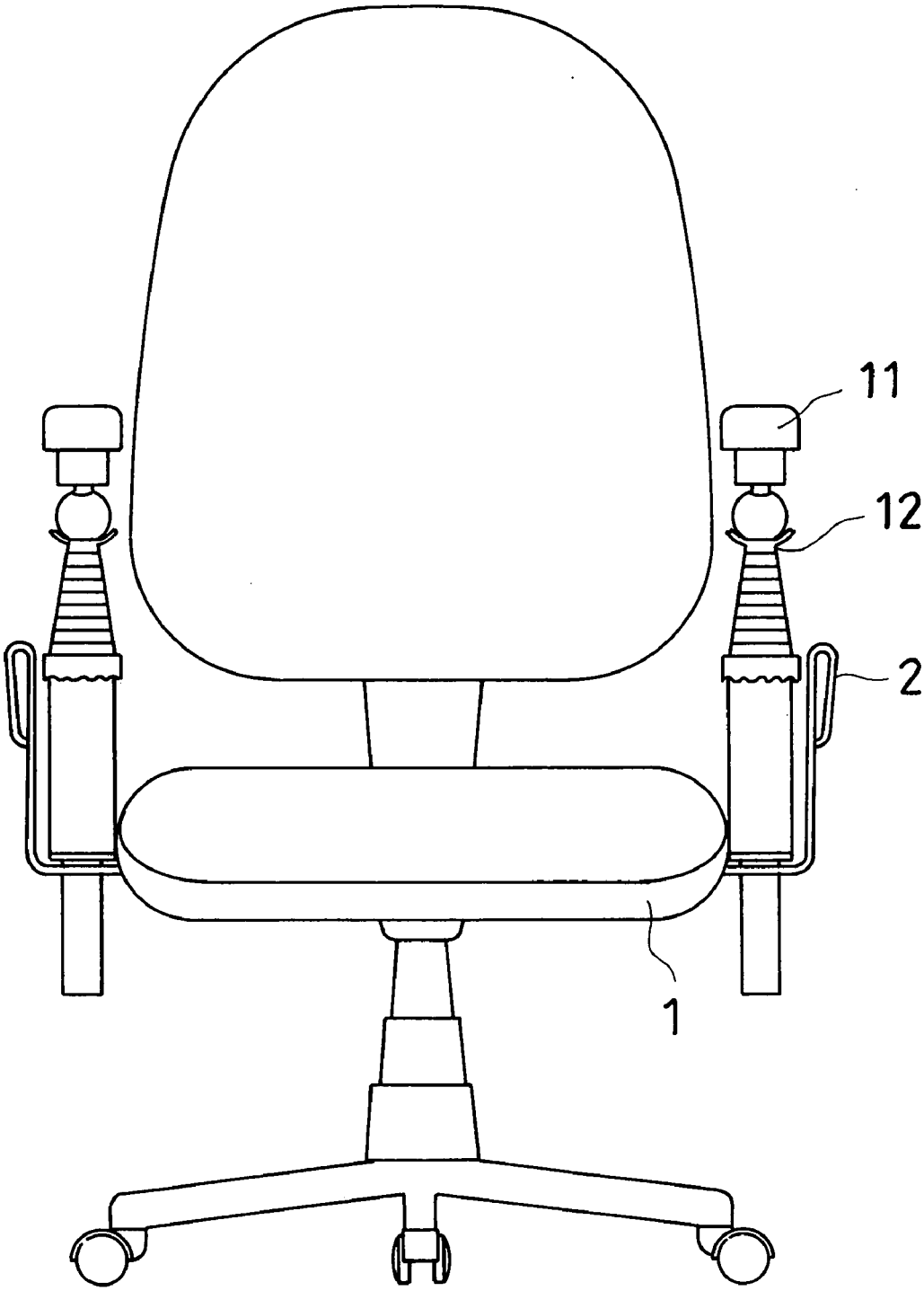
FIG. 1 is a front view of a chair according to the present invention.
Figure 2:
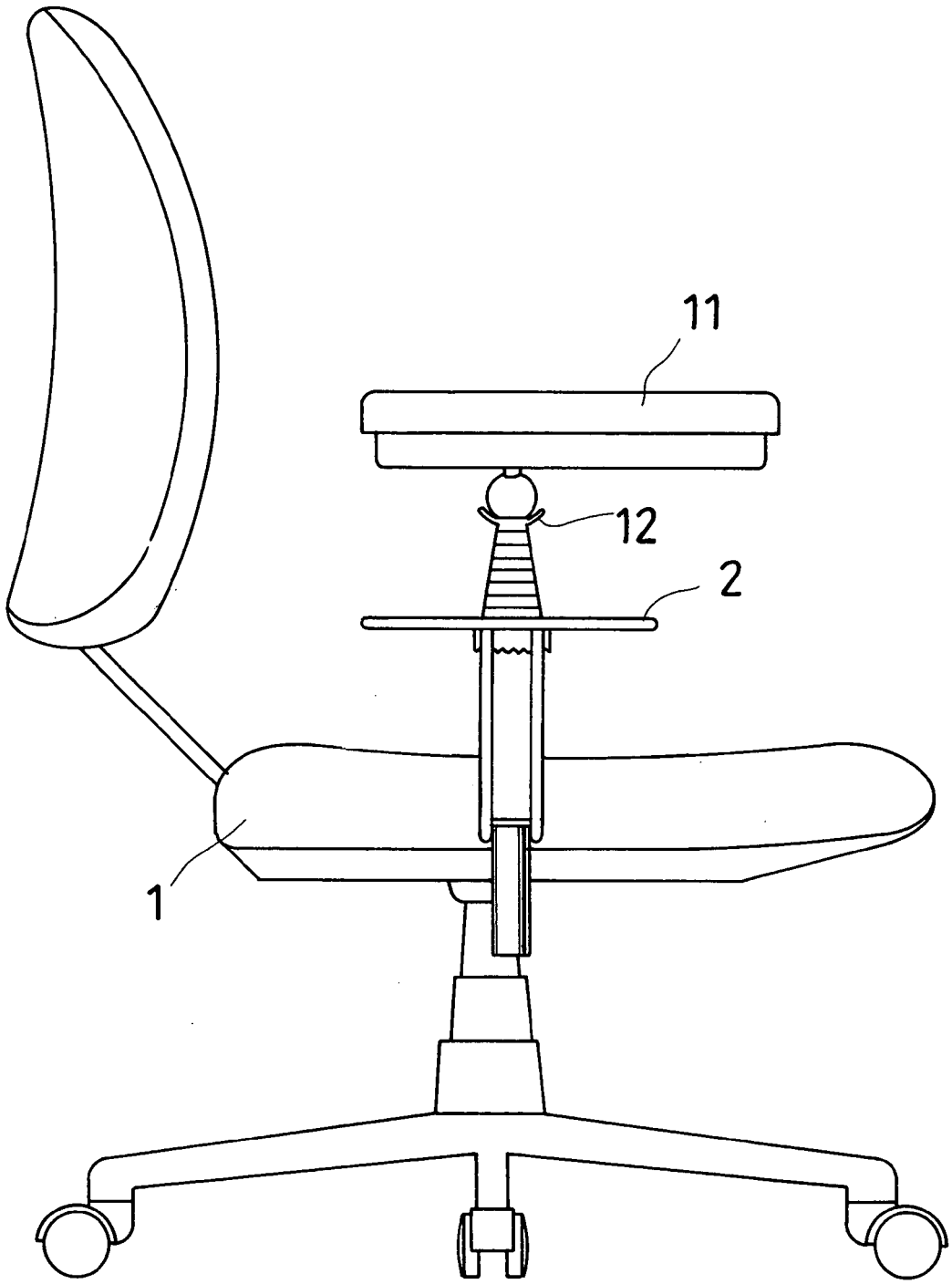
FIG. 2 is a side of the chair according to the present invention.
Figure 3:
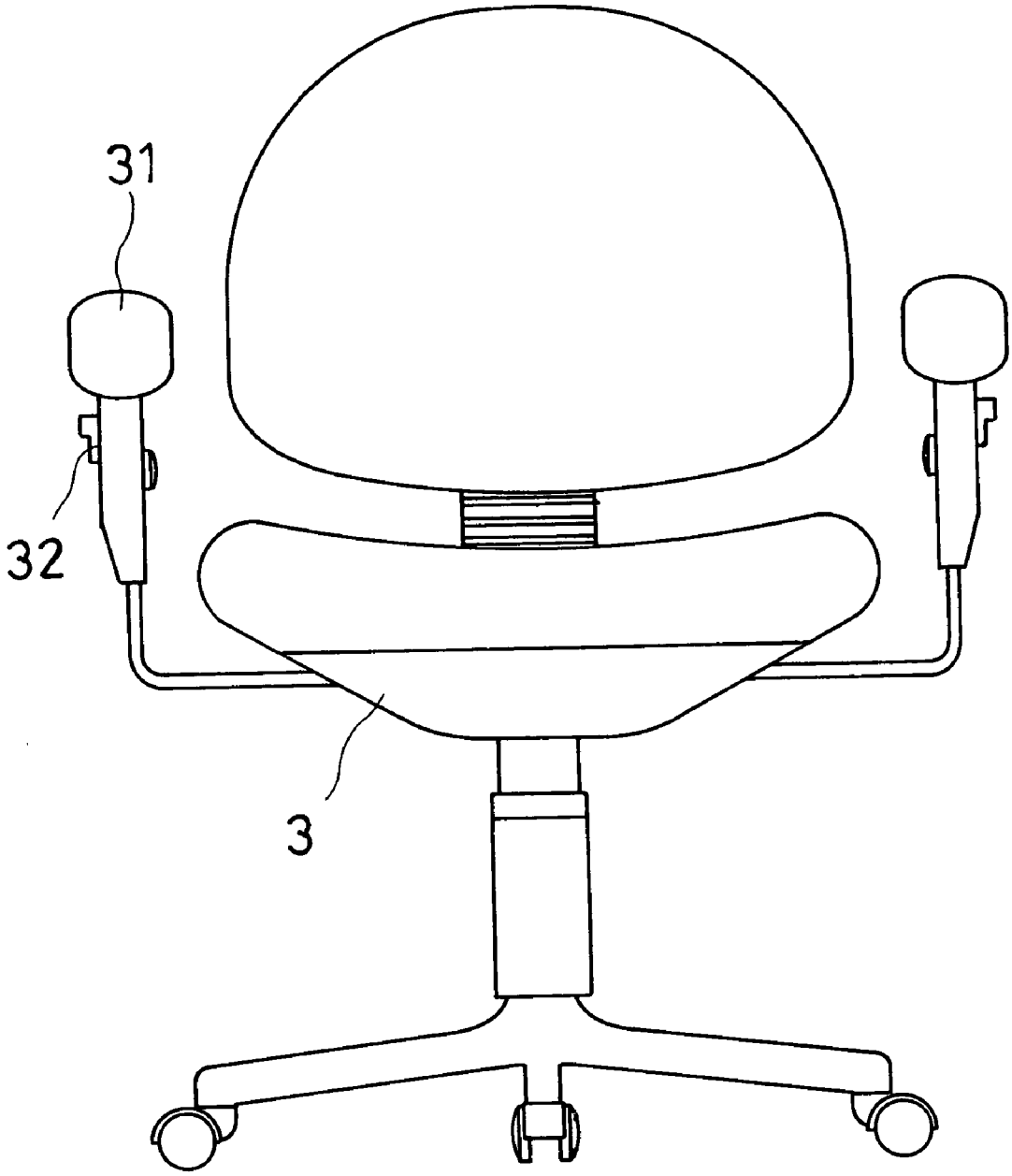
F I G. 3 (PRIOR ART)
FIG. 3 is a front view of the conventional chair as described in the Background.
Figure 4:
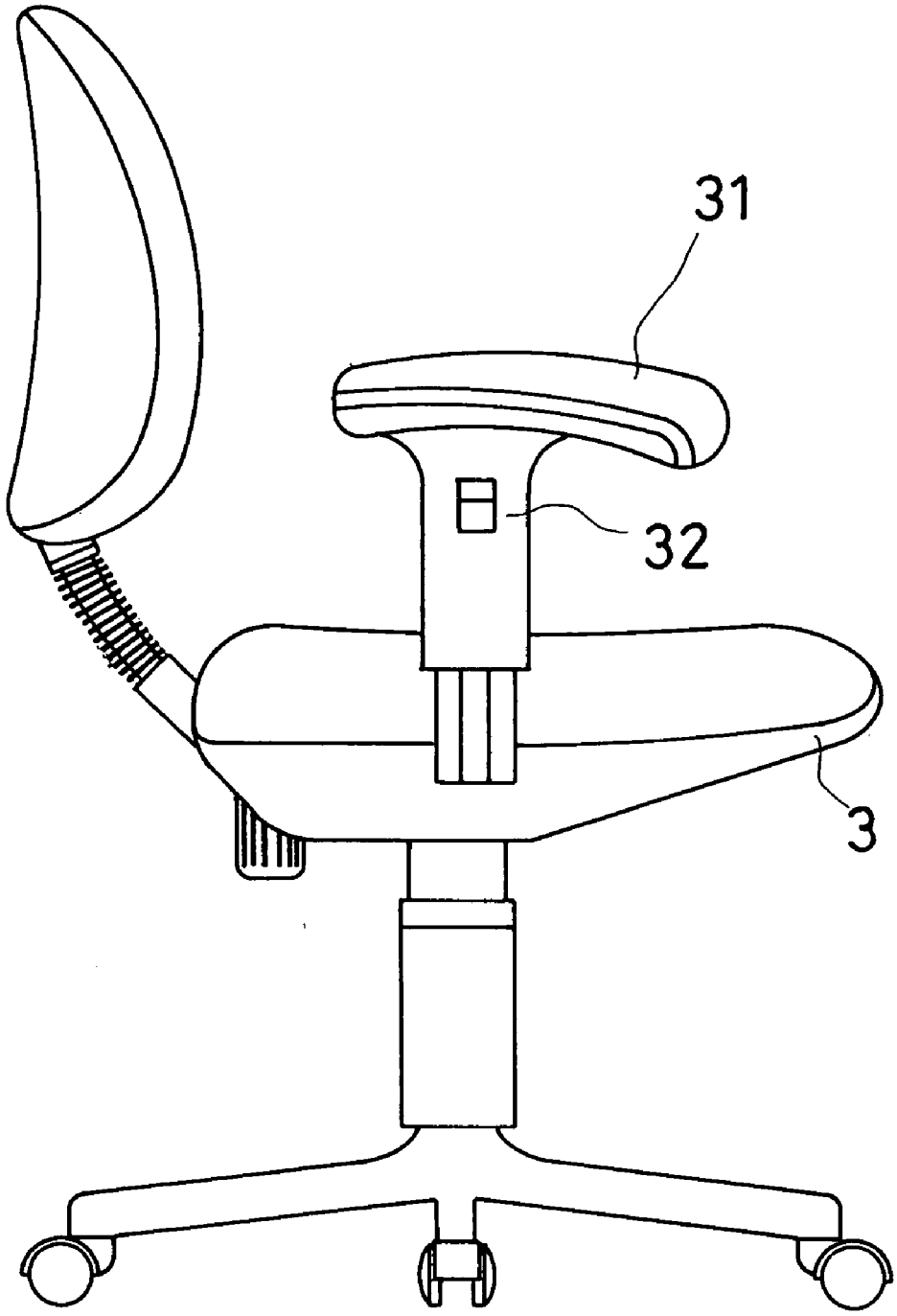
F I G. 4 (PRIOR ART)
FIG. 4 is a side view of the conventional chair.

Referring to FIGS. 1 and 2, a preferred embodiment of a chair in the present invention includes a seat 1, armrest main bodies 11 on two sides of the seat 1, adjustment mechanisms 12, and auxiliary security units 2.

The adjustment mechanisms 12 are connected to the seat and a respective one of the armrest main bodies 11 such that the armrest main bodies 11 can be adjusted in the height and the orientation relative to the seat 1 by means of operating the adjustment mechanisms 12. The auxiliary security units 2 are arranged opposite outward sides of the armrest main bodies 11, and securely joined to the seat 1.

Thus, the sitter can press his hands against the auxiliary security units 2 instead of the armrest main bodies 11, and prop his upper body up with the hands to help him stand up from the seat 1. In other words, with the auxiliary security units 2, it is safe for the sitter to prop his/her upper body up with the help of the hands when he/she is standing up from the seat.

From the above description, it can be easily understood that the armrest of the present invention is much safer and more convenient to use than the conventional armrests.

What is claimed is:

1. An improvement on an armrest of a chair, comprising:

an adjustment mechanism connected to one lateral side of a seat;

an armrest main body secured to the adjustment mechanism for allowing a user to rest one hand thereon, the adjustment mechanism positionally adjusting the armrest body relative to the seat; and, an auxiliary security unit located laterally outwardly of the armrest main body and the adjustment mechanism and secured to the seat for allowing the user to press a corresponding hand thereagainst when the user is standing up from the seat.

* * * * *